US006490803B1

(12) United States Patent
Butters

(10) Patent No.: US 6,490,803 B1
(45) Date of Patent: Dec. 10, 2002

(54) BATTER BOARD

(76) Inventor: William E. Butters, 1936 Tabby La., Alta Vista, VA (US) 24517

( * ) Notice: Subject to any disclaimer, the term of this patent is extended or adjusted under 35 U.S.C. 154(b) by 0 days.

(21) Appl. No.: 09/899,964

(22) Filed: Jul. 6, 2001

(51) Int. Cl.[7] ..... E04G 21/18
(52) U.S. Cl. ..... 33/405; 52/102; 33/1 LE
(58) Field of Search ..... 33/405, 1 G, 1 LE, 33/404, 406, 413; 52/102, 712, 588.1; 249/6

(56) References Cited

U.S. PATENT DOCUMENTS

| | | | | | |
|---|---|---|---|---|---|
| 1,609,912 | A | * | 12/1926 | Mazeau | |
| 3,861,046 | A | * | 1/1975 | Arn | 33/86 |
| 4,080,739 | A | | 3/1978 | Ruhaak | |
| 4,869,018 | A | * | 9/1989 | Scales et al. | 47/33 |
| 4,924,579 | A | | 5/1990 | Berendsen | |
| 4,932,134 | A | | 6/1990 | Meadows | |
| 5,263,584 | A | * | 11/1993 | Sevey | 206/349 |
| 5,419,055 | A | * | 5/1995 | Meadows | 33/518 |
| 5,621,976 | A | * | 4/1997 | Ochsenbine | 33/339 |
| 5,657,548 | A | * | 8/1997 | Kellar, Sr. | 33/405 |
| 5,778,546 | A | | 7/1998 | Williamson | |
| 5,897,816 | A | | 4/1999 | Johnson | |
| D411,119 | S | | 6/1999 | Johnston | |

FOREIGN PATENT DOCUMENTS

| | | | |
|---|---|---|---|
| JP | 362276118 | A | * 12/1987 |
| JP | 404297661 | A | * 10/1992 |

* cited by examiner

*Primary Examiner*—Diego Gutierrez
*Assistant Examiner*—Tania C. Courson

(57) ABSTRACT

A batter board for aiding in the placement and alignment of foundation lines and other structural elements. The batter board includes a main crossmember that has a slot along the top surface in which an alignment device slides for positioning an alignment line. There are mounting collars on both ends for mounting to stakes in the ground and are vertically offset so that multiple members can be interconnected.

20 Claims, 6 Drawing Sheets

BATTER BOARD

BACKGROUND OF THE INVENTION

1. Field of the Invention

The present invention relates to batter boards and more particularly pertains to a new batter board for aiding in the placement and alignment of foundation lines and other structural elements.

2. Description of the Prior Art

The use of batter boards is known in the prior art. More specifically, batter boards heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,080,739; U.S. Pat. No. 5,778,546; U.S. Pat. No. 4,932,134; U.S. Pat. No. 4,924,579; U.S. Pat. No. 5,897,816; and U.S. Pat. No. Des. 411,119.

While these devices fulfill their respective, particular objectives and requirements, the aforementioned patents do not disclose a new batter board. The inventive device includes a main crossmember that has a slot along the top surface in which an alignment device slides for positioning an alignment line. There are mounting collars on both ends for mounting to stakes in the ground and are vertically offset so that multiple members can be interconnected.

In these respects, the batter board according to the present invention substantially departs from the conventional concepts and designs of the prior art, and in so doing provides an apparatus primarily developed for the purpose of for aiding in the placement and alignment of foundation lines and other structural elements.

SUMMARY OF THE INVENTION

In view of the foregoing disadvantages inherent in the known types of batter boards now present in the prior art, the present invention provides a new batter board construction wherein the same can be utilized for aiding in the placement and alignment of foundation lines and other structural elements.

The general purpose of the present invention, which will be described subsequently in greater detail, is to provide a new batter board apparatus and method which has many of the advantages of the batter boards mentioned heretofore and many novel features that result in a new batter board which is not anticipated, rendered obvious, suggested, or even implied by any of the prior art batter boards, either alone or in any combination thereof.

To attain this, the present invention generally comprises a main crossmember that has a slot along the top surface in which an alignment device slides for positioning an alignment line. There are mounting collars on both ends for mounting to stakes in the ground and are vertically offset so that multiple members can be interconnected.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new batter board apparatus and method which has many of the advantages of the batter boards mentioned heretofore and many novel features that result in a new batter board which is not anticipated, rendered obvious, suggested, or even implied by any of the prior art batter boards, either alone or in any combination thereof.

It is another object of the present invention to provide a new batter board which may be easily and efficiently manufactured and marketed.

It is a further object of the present invention to provide a new batter board which is of a durable and reliable construction.

An even further object of the present invention is to provide a new batter board which is susceptible of a low cost of manufacture with regard to both materials and labor, and which accordingly is then susceptible of low prices of sale to the consuming public, thereby making such batter board economically available to the buying public.

Still yet another object of the present invention is to provide a new batter board which provides in the apparatuses and methods of the prior art some of the advantages thereof, while simultaneously overcoming some of the disadvantages normally associated therewith.

Still another object of the present invention is to provide a new batter board for aiding in the placement and alignment of foundation lines and other structural elements.

Yet another object of the present invention is to provide a new batter board which includes a main crossmember that has a slot along the top surface in which an alignment device slides for positioning an alignment line. There are mounting collars on both ends for mounting to stakes in the ground and are vertically offset so that multiple members can be interconnected.

Still yet another object of the present invention is to provide a new batter board that is lightweight and versatile in design.

Even still another object of the present invention is to provide a new batter board that is reusable and more accurate than on-site built batter boards.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
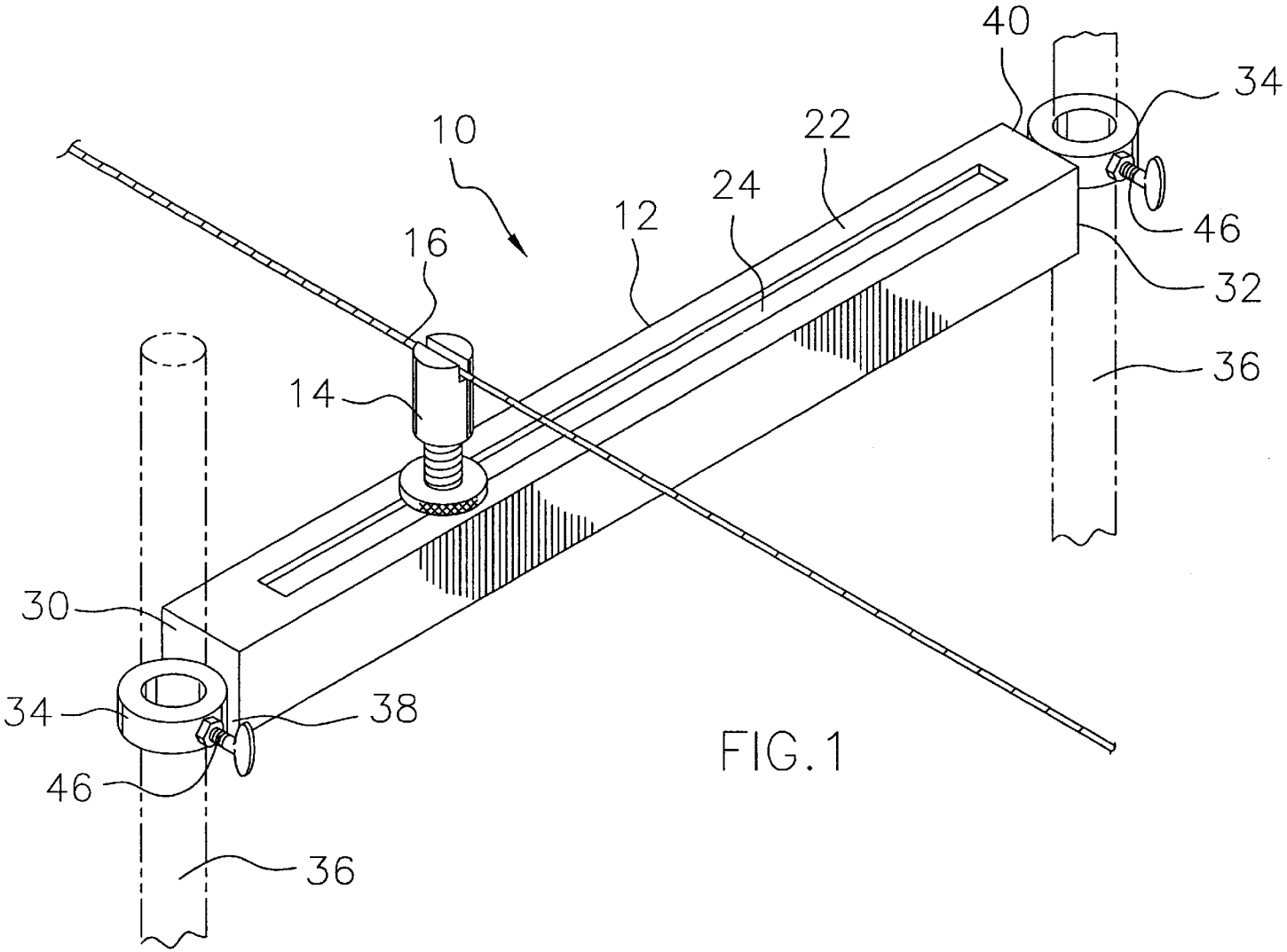
FIG. 1 is a schematic perspective view of a new batter board according to the present invention.
Figure 2:
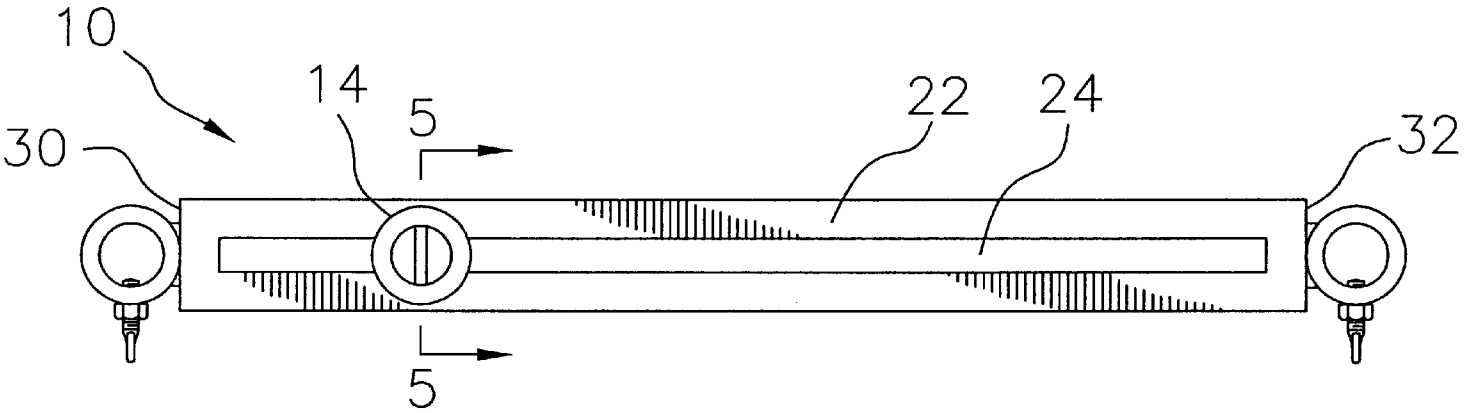
FIG. 2 is a schematic top view of the present invention.
Figure 3:
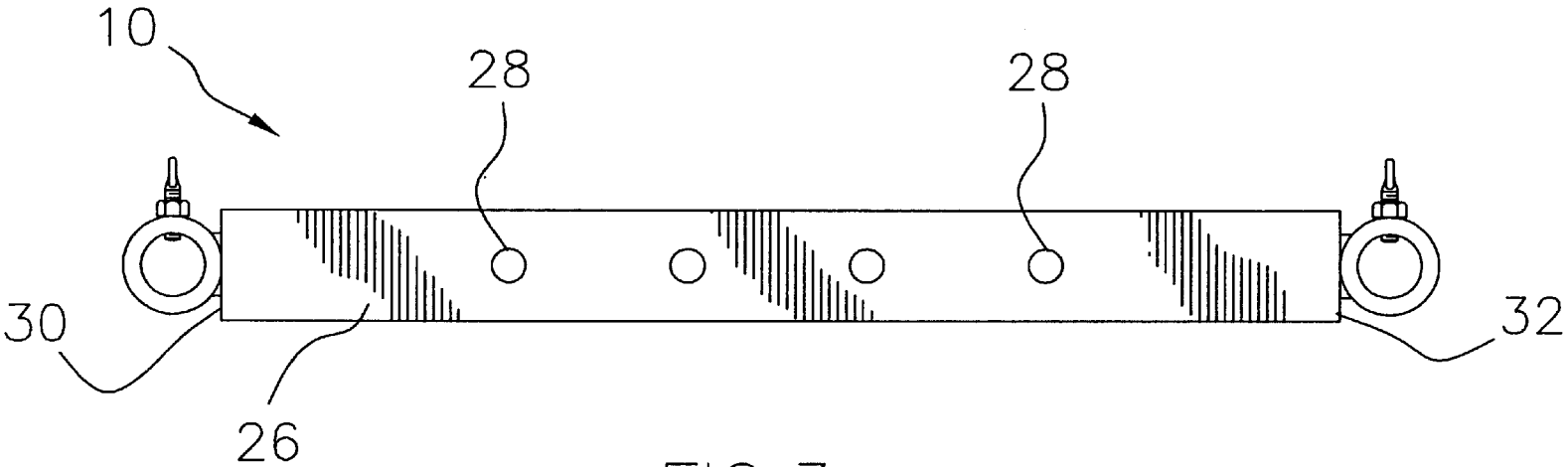
FIG. 3 is a schematic bottom view of the present invention.
Figure 4:
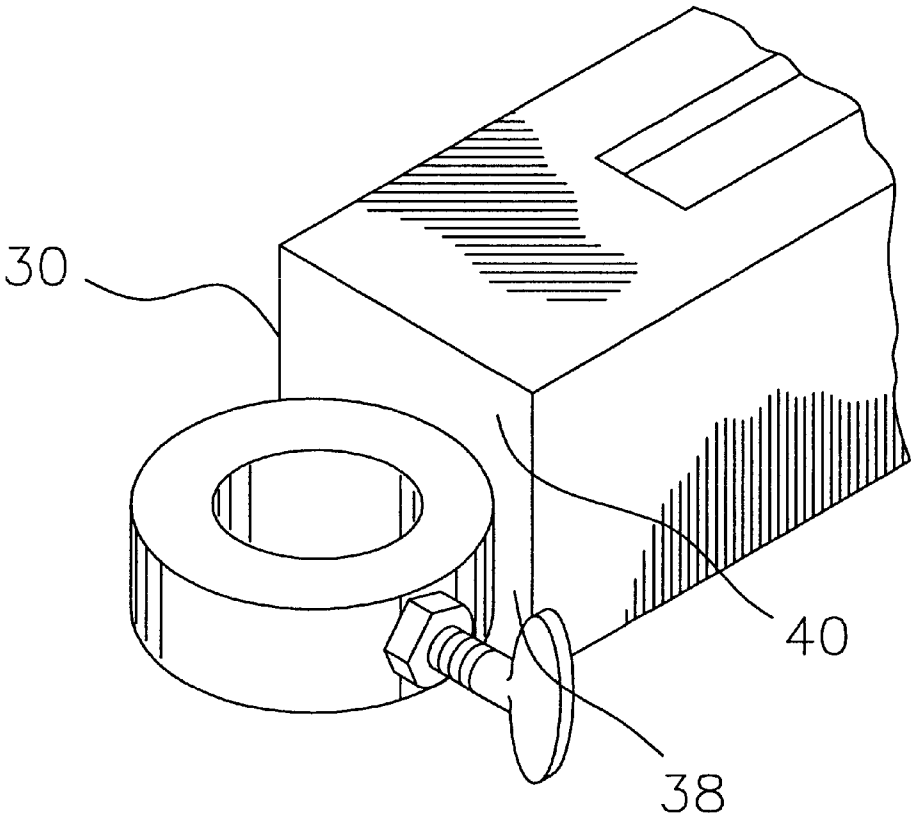
FIG. 4 is a schematic perspective view of a sleeve member of the present invention.
Figure 5B:
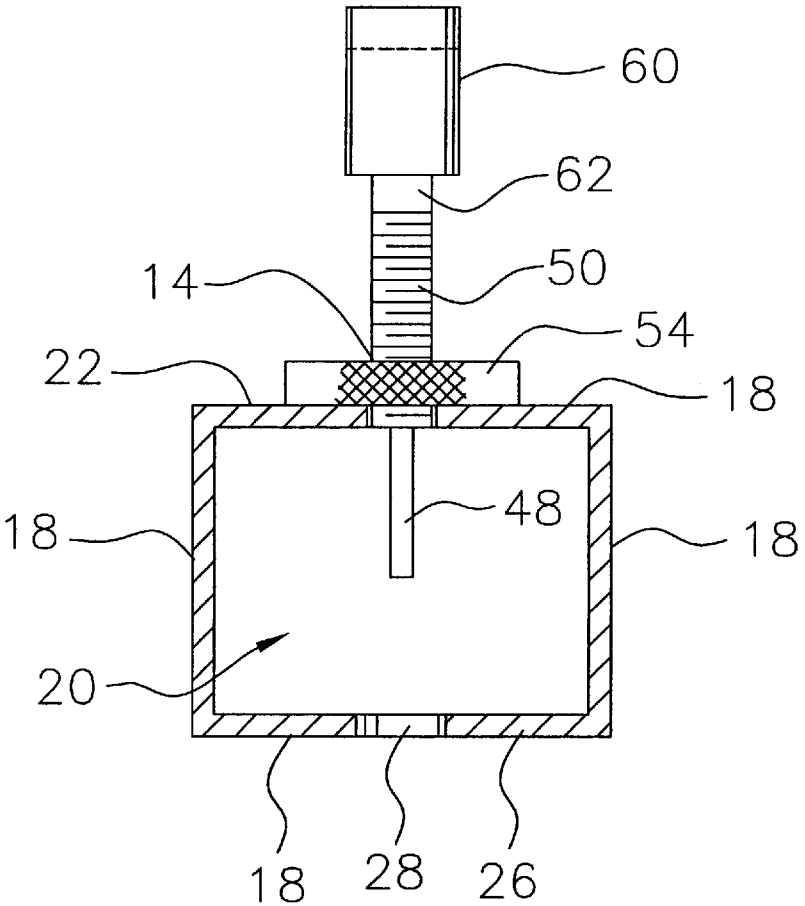
FIG. 5B is a schematic cross-sectional view of the main member and the alignment device in the insertable position.
Figure 5A:
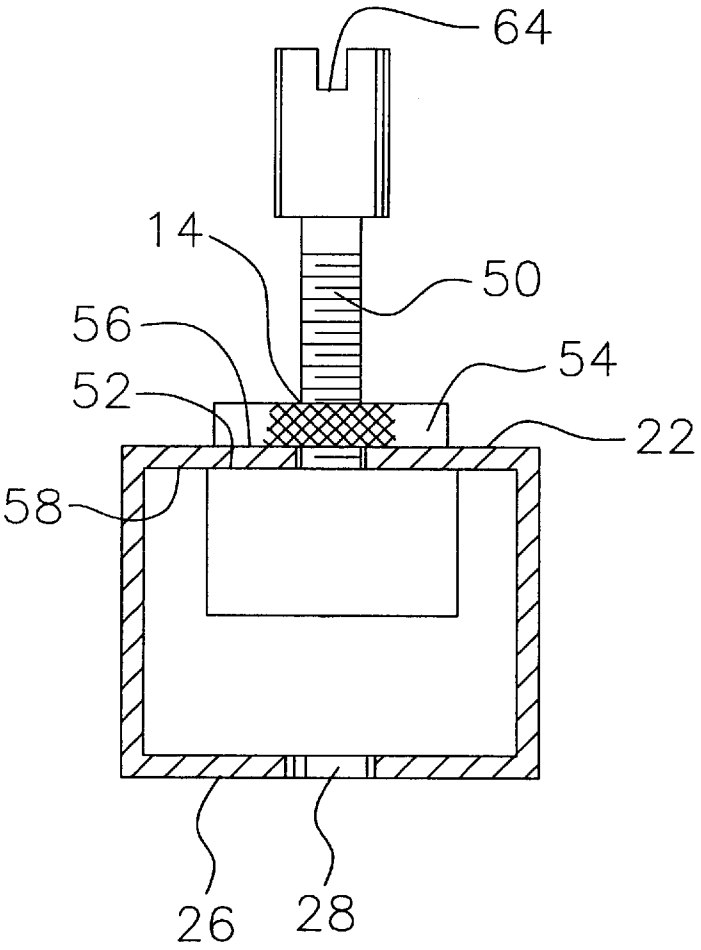
FIG. 5A is a schematic cross-sectional view of the main member and the alignment device in the locking position.
Figure 6:
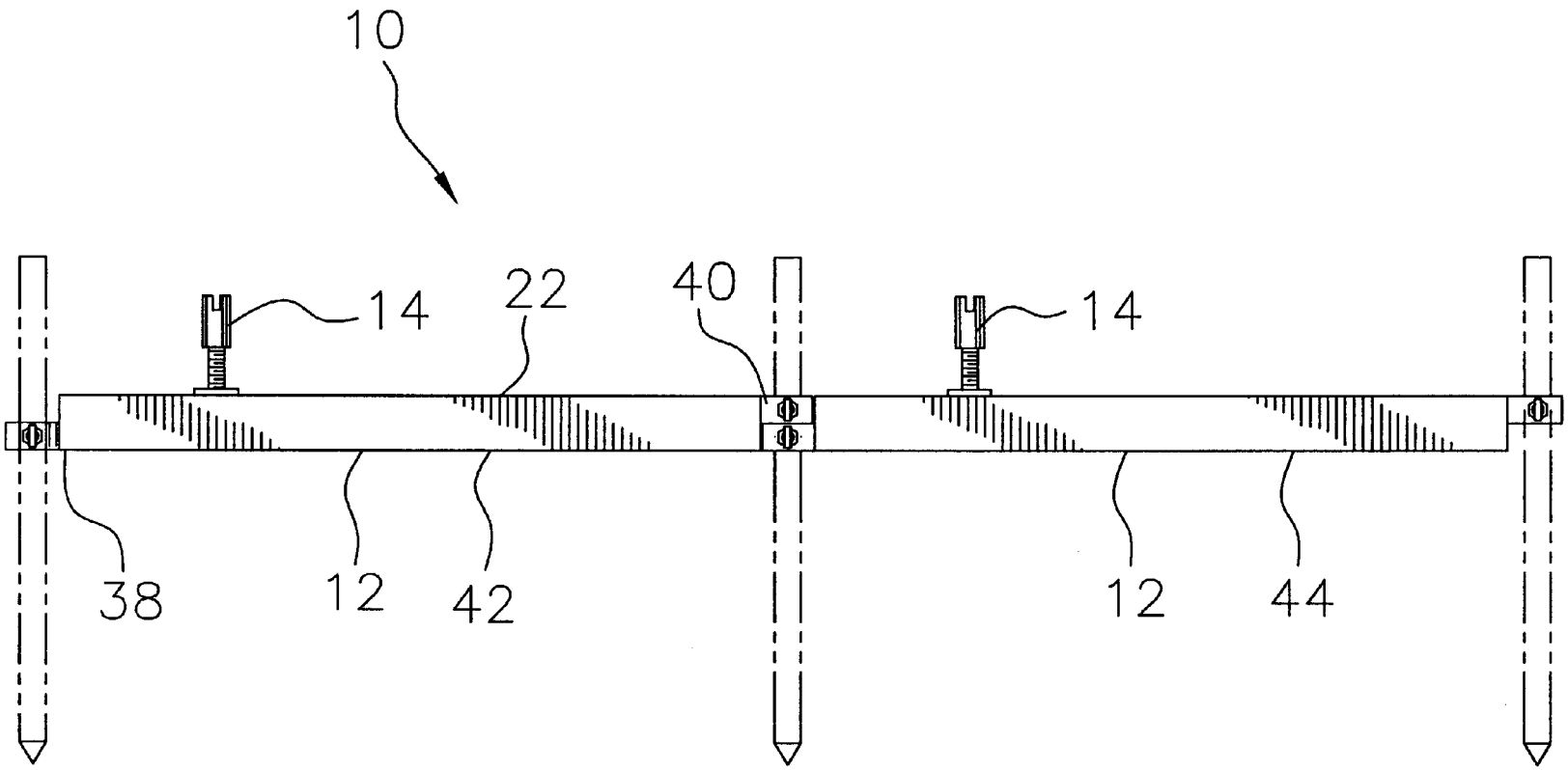
FIG. 6 is a schematic side view of two members interconnected.
Figure 7:
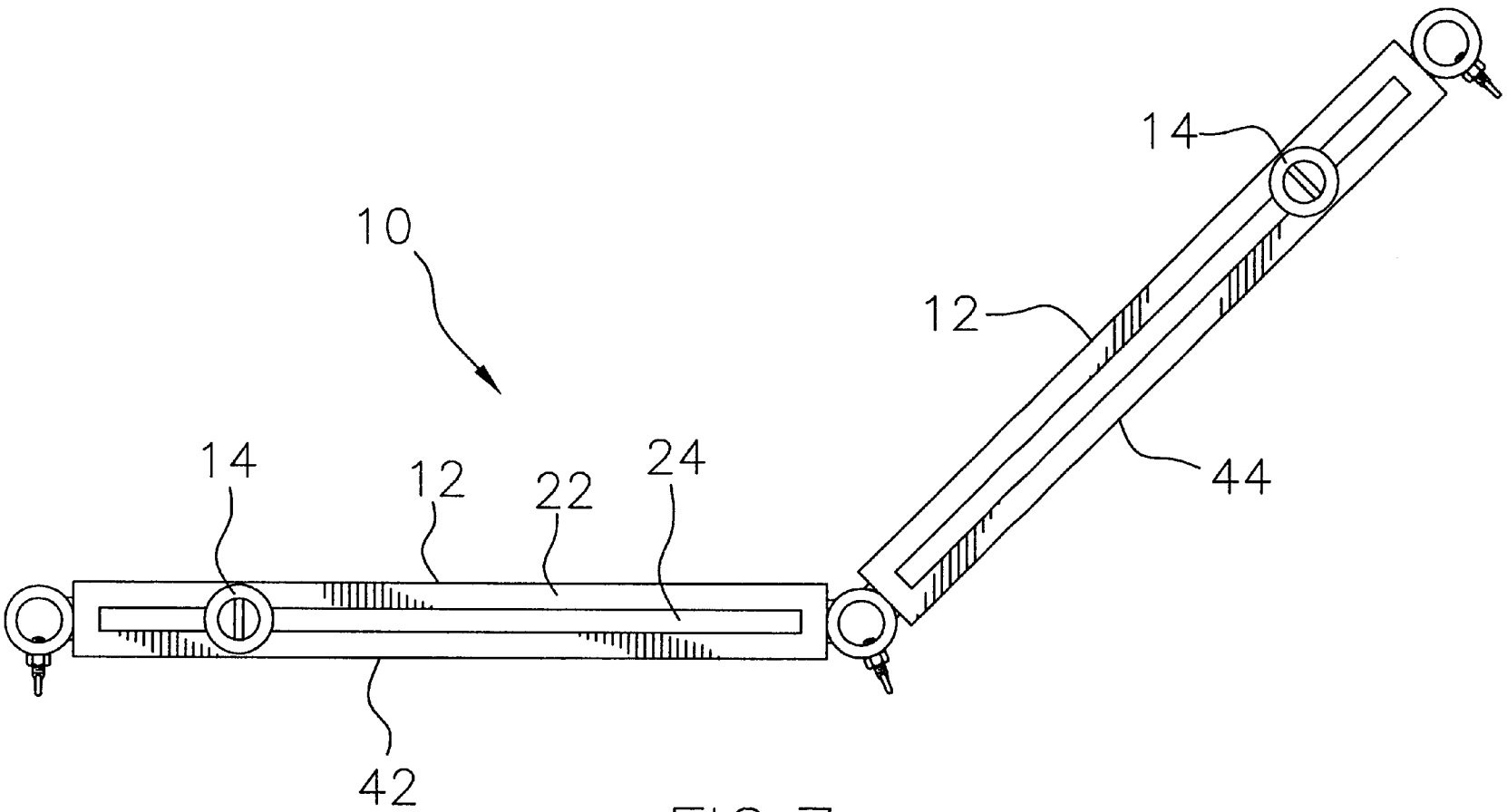
FIG. 7 is a schematic top view of two members interconnected.

With reference now to the drawings, and in particular to FIGS. 1 through 7 thereof, a new batter board embodying the principles and concepts of the present invention and generally designated by the reference numeral 10 will be described.

As best illustrated in FIGS. 1 through 7, the batter board 10 generally comprises an elongate member 12. The elongate member 12 is for holding an alignment device 14 in a fixed position such that an alignment line 16 is selectively couplable to the alignment device 14 for positioning the alignment line 16 to facilitate the placement of construction forms or the like.

The elongate member 12 includes exterior surfaces 18. The exterior surfaces 18 define an interior space 20.

A top surface 22 of the elongate member 12 includes a slot 24. The slot 24 is located in a medial portion of the top surface 22 comprising approximately the full length along a longitudinal axis of the elongate member 12. The slot 24 is for receiving the alignment device 14 such that the alignment device 14 may be positioned at any point along the slot 24 for positioning of the alignment line 16.

The elongate member 12 includes a bottom surface 26. The bottom surface 26 includes a plurality of drain holes 28. The plurality of drain holes 28 are located in a medial portion of the bottom surface 26 extending approximately the full length along a longitudinal axis of the elongate member 12. The drain holes 28 are equally spaced along the longitudinal axis of the elongate member 12 for allowing moisture captured within the interior space 20 of the elongate member 12 to drain out.

The elongate member 12 includes a first end 30 and a second end 32. The first and second ends 30, 32 include a sleeve member 34. The sleeve member 34 is for receiving a mounting post 36 for facilitating the attachment of the elongate member 12 to a ground surface.

The sleeve member 34 of the first end 30 is located on a lower portion 38 of the first end 30. The sleeve member 34 of the second end 32 is located on an upper portion 40 of the second end 32 such that a first end 30 of a first elongate member 42 is designed for overlapping a sleeve member 34 of a second elongate member 44 such that a plurality of elongate member 12 may be interconnected.

The sleeve members 34 include a locking member 46. The locking member 46 is for selectively coupling the elongate member 12 to the mounting post 36 at any position along a longitudinal axis of the mounting post 36.

The locking member 46 is positioned on the sleeve member 34 substantially perpendicular to the longitudinal axis of the elongate member 12 such that the locking member 46 is accessible when the plurality of elongate members 12 are interconnected.

The alignment device 14 includes a slot plate 48. The slot plate 48 is for inserting into the slot 24 of the elongate member 12.

The alignment device 14 includes a securing post 50 that is fixedly coupled to a medial section of a top edge 52 of the slot plate 48 such that when the slot plate 48 is fully received by the slot 24, the securing post 50 is oriented substantially perpendicular to the top surface 22 of the elongate member 12.

The alignment device 14 includes a locking collar 54. The locking collar 54 includes a bottom side 56 which abuts the top surface 22 of the elongate member 12 when the alignment device 14 is fully received by the slot 24.

The locking collar 54 is threadably coupled to the securing post 50 such that rotation of the locking collar 54 biases the securing post 50 upwardly and downwardly.

The top edge 52 of the slot plate 48 abuts an opposing surface 58 of the top surface 22 when the locking collar 54 biases the securing post 50 upwardly and the slot plate 48 is oriented substantially perpendicular to the slot 24, thereby selectively coupling the alignment device 14 to the top surface 22 of the elongate member 12.

The alignment device 14 includes an alignment cap 60. The alignment cap 60 is threadably coupled to an upper end 62 of the securing post 50.

The alignment cap 60 includes an alignment slot 64. The alignment slot 64 is for receiving the alignment line 16 when the alignment device 14 is positioned along the slot 24 of the elongate member 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A batter board for aiding in the alignment of foundation lines and other structural elements, the batter board comprising:

an elongate member having an interior space, said elongate member being for holding an alignment device in a fixed position such that an alignment line is selectively couplable to said alignment device for positioning the alignment line to facilitate the placement of construction forms or the like; and a bottom surface of said elongate member having a plurality of drain holes for allowing moisture captured within said interior space of said elongate member to drain out.

2. The batter board as set forth in claim 1, further comprising:

said elongate member having exterior surfaces, said exterior surfaces defining said interior space;

a top surface of said elongate member having a slot, said slot being located in a medial portion of said top surface comprising approximately the full length along a longitudinal axis of said elongate member, said slot being for receiving said alignment device such that said alignment device may be positioned at any point along said slot for positioning of said alignment line.

3. The batter board as set forth in claim 1, further comprising:

said plurality of drain holes being located in a medial portion of said bottom surface comprising approximately the full length along a longitudinal axis of said elongate member and being equally spaced along the longitudinal axis of said elongate member.

4. The batter board as set forth in claim 1, further comprising:

said elongate member having a first end and a second end, said first and second ends including a sleeve member, said sleeve member being for receiving a mounting post for facilitating the attachment of said elongate member to a ground surface; and said sleeve member of said first end being located on a lower portion of said first end and said sleeve member of said second end being located on an upper portion of said second end such that a first end of a first elongate member is adapted for overlapping a sleeve member of a second elongate member to facilitate end to end interconnection of said elongate members.

5. The batter board as set forth in claim 4, further comprising:

said sleeve members having a locking member, said locking members being for selectively coupling said elongate members to said mounting posts at any position along a longitudinal axis of said mounting posts; and said locking members being positioned on said sleeve members substantially perpendicular to the longitudinal axis of said elongate members such that said locking members are accessible when said plurality of elongate members are interconnected.

6. The batter board as set forth in claim 2, further comprising:

said alignment device having a slot plate, said slot plate being for inserting into said slot of said elongate member.

7. The batter board as set forth in claim 6, further comprising:

said alignment device having a securing post being fixedly coupled to a medial section of a top edge of said slot plate such that when said slot plate is fully received by said slot in said elongate member said securing post is oriented substantially perpendicular to said top surface of said elongate member.

8. The batter board as set forth in claim 7, further comprising:

said alignment device having a locking collar, said locking collar having a bottom side, said bottom side abuts said top surface of said elongate member when said alignment device is fully received by said slot;

said locking collar being threadably coupled to said securing post such that rotation of said locking collar biases said securing post upwardly and downwardly; and said top edge of said slot plate abuts an opposing surface of said top surface when said locking collar biases said securing post upwardly and said slot plate is oriented substantially perpendicular to said slot, thereby selectively coupling said alignment device to said top surface of said elongate member.

9. The batter board as set forth in claim 8, further comprising:

said alignment device having an alignment cap, said alignment cap being threadably coupled to an upper end of said securing post;

said alignment cap having an alignment slot, said alignment slot being for receiving said alignment line when said alignment device is positioned along said slot of said elongate member.

10. A batter board for aiding in the alignment of foundation lines and other structural elements, the batter board comprising:

an elongate member, said elongate member being for holding an alignment device in a fixed position such that an alignment line is selectively couplable to said alignment device for positioning said alignment line to facilitate the placement of construction forms or the like;

said elongate member having exterior surfaces, said exterior surfaces defining an interior space;

a top surface of said elongate member having a slot, said slot being located in a medial portion of said top surface comprising approximately the full length along a longitudinal axis of said elongate member, said slot being for receiving said alignment device such that said alignment device may be positioned at any point along said slot for positioning of the alignment line; and said elongate member having a bottom surface, said bottom surface having a plurality of drain holes, said plurality of drain holes being located in a medial portion of said bottom surface comprising approximately the full length along a longitudinal axis of said elongate member and being equally spaced along the longitudinal axis of said elongate member for allowing moisture captured within said interior space of said elongate member to drain out.

11. The batter board as set forth in claim 10, further comprising:

said elongate member having a first end and a second end, said first and second ends including a sleeve member, said sleeve member being for receiving a mounting post for facilitating the attachment of said elongate member to a ground surface; and said sleeve member of said first end being located on a lower portion of said first end and said sleeve member of said second end being located on an upper portion of said second end such that a first end of a first elongate member is adapted for overlapping a sleeve member of a second elongate member to facilitate end to end interconnection of said elongate members.

12. The batter board as set forth in claim 11, further comprising:

said sleeve members having a locking member, said locking members being for selectively coupling said elongate members to said mounting posts at any position along a longitudinal axis of said mounting posts; and said locking members being positioned on said sleeve members substantially perpendicular to the longitudinal axis of said elongate members such that said locking members are accessible when said plurality of elongate members are interconnected.

13. The batter board as set forth in claim 12, further comprising:

said alignment device having a slot plate, said slot plate being for inserting into said slot of said elongate member.

14. The batter board as set forth in claim 13, further comprising:

said alignment device having a securing post being fixedly coupled to a medial section of a top edge of said slot plate such that when said slot plate is fully received by said slot in said elongate member said securing post is oriented substantially perpendicular to said top surface of said elongate member.

15. The batter board as set forth in claim 14, further comprising:

said alignment device having a locking collar, said locking collar having a bottom side, said bottom side abuts said top surface of said elongate member when said alignment device is fully received by said slot;

said locking collar being threadably coupled to said securing post such that rotation of said locking collar biases said securing post upwardly and downwardly; and said top edge of said slot plate abuts an opposing surface of said top surface when said locking collar biases said securing post upwardly and said slot plate is oriented substantially perpendicular to said slot, thereby selectively coupling said alignment device to said top surface of said elongate member.

16. The batter board as set forth in claim 15, further comprising:

said alignment device having an alignment cap, said alignment cap being threadably coupled to an upper end of said securing post;

said alignment cap having an alignment slot, said alignment slot being for receiving said alignment line when said alignment device is positioned along said slot of said elongate member.

17. A batter board for aiding in the alignment of foundation lines and other structural elements, the batter board comprising:

an elongate member, said elongate member being for holding an alignment device in a fixed position such that an alignment line is selectively couplable to said alignment device for positioning said alignment line to facilitate the placement of construction forms or the like;

said elongate member having exterior surfaces, said exterior surfaces defining an interior space;

a top surface of said elongate member having a slot, said slot being located in a medial portion of said top surface comprising approximately the full length along a longitudinal axis of said elongate member, said slot being for receiving said alignment device such that said alignment device may be positioned at any point along said slot for positioning of the alignment line;

said alignment device having a slot plate, said slot plate being for inserting into said slot of said elongate member;

said alignment device having a securing post being fixedly coupled to a medial section of a top edge of said slot plate such that when said slot plate is fully received by said slot in said elongate member said securing post is oriented substantially perpendicular to said top surface of said elongate member;

said alignment device having a locking collar, said locking collar having a bottom side, said bottom side abuts said top surface of said elongate member when said alignment device is fully received by said slot;

said locking collar being threadably coupled to said securing post such that rotation of said locking collar biases said securing post upwardly and downwardly;

said top edge of said slot plate abuts an opposing surface of said top surface when said locking collar biases said securing post upwardly and said slot plate is oriented substantially perpendicular to said slot, thereby selectively coupling said alignment device to said top surface of said elongate member;

said alignment device having an alignment cap, said alignment cap being threadably coupled to an upper end of said securing post; and said alignment cap having an alignment slot, said alignment slot being for receiving said alignment line when said alignment device is positioned along said slot of said elongate member.

18. The batter board as set forth in claim 17, further comprising:

said elongate member having a bottom surface, said bottom surface having a plurality of drain holes, said plurality of drain holes being located in a medial portion of said bottom surface comprising approximately the full length along a longitudinal axis of said elongate member and being equally spaced along the longitudinal axis of said elongate member for allowing moisture captured within said interior space of said elongate member to drain out.

19. The batter board as set forth in claim 17, further comprising:

said elongate member having a first end and a second end, said first and second ends including a sleeve member, said sleeve member being for receiving a mounting post for facilitating the attachment of said elongate member to a ground surface; and said sleeve member of said first end being located on a lower portion of said first end and said sleeve member of said second end being located on an upper portion of said second end such that a first end of a first elongate member is adapted for overlapping a sleeve member of a second elongate member to facilitate end to end interconnection of said elongate members.

20. The batter board as set forth in claim 19, further comprising:

said sleeve members having a locking member, said locking members being for selectively coupling said elongate members to said mounting posts at any position along a longitudinal axis of said mounting posts; and said locking members being positioned on said sleeve members substantially perpendicular to the longitudinal axis of said elongate members such that said locking members are accessible when said plurality of elongate members are interconnected.

* * * * *